US006240904B1

(12) United States Patent
Meyer et al.

(10) Patent No.: US 6,240,904 B1
(45) Date of Patent: Jun. 5, 2001

(54) STAND ALONE MULTI STAGE FUEL PUMP

(75) Inventors: Paul M. Meyer; Ralph Ulm; Rodney Boutwell; Bruce Stephens, all of Fairfield, IL (US)

(73) Assignee: UIS, Inc., Jersey City, NJ (US)

( * ) Notice: Subject to any disclaimer, the term of this patent is extended or adjusted under 35 U.S.C. 154(b) by 0 days.

(21) Appl. No.: 09/592,792

(22) Filed: Jun. 13, 2000

(51) Int. Cl.[7] ..... F02M 37/04; F04B 3/00

(52) U.S. Cl. ..... 123/495; 123/514; 417/62; 417/251

(58) Field of Search ..... 123/509, 495, 123/497, 514, 445; 417/62, 244, 251

(56) References Cited

U.S. PATENT DOCUMENTS

| | | | | |
|---|---|---|---|---|
| 3,835,822 | | 9/1974 | Mickle et al. . | |
| 3,973,536 | | 8/1976 | Zelders . | |
| 4,084,564 | | 4/1978 | Rickert . | |
| 4,336,002 | * | 6/1982 | Rose et al. | 417/251 |
| 4,689,025 | | 8/1987 | Ferguson . | |
| 4,728,306 | | 3/1988 | Schneider . | |
| 4,768,492 | | 9/1988 | Widmer et al. . | |
| 4,776,315 | * | 10/1988 | Greiner | 123/509 |
| 4,848,283 | | 7/1989 | Garms et al. . | |
| 4,974,570 | * | 12/1990 | Szwargulski et al. | 123/509 |
| 4,980,588 | | 12/1990 | Ogawa . | |
| 5,015,159 | | 5/1991 | Mine et al. . | |
| 5,046,471 | | 9/1991 | Schmid . | |
| 5,050,567 | * | 9/1991 | Suzuki | 123/509 |
| 5,103,793 | | 4/1992 | Riese et al. . | |
| 5,129,796 | * | 7/1992 | Emmert et al. | 417/251 |
| 5,231,967 | | 8/1993 | Baltz et al. . | |
| 5,392,750 | * | 2/1995 | Laue et al. | 123/509 |
| 5,413,457 | * | 5/1995 | Tuckey | 417/251 |
| 5,435,691 | * | 7/1995 | Braun et al. | 123/509 |
| 5,438,962 | | 8/1995 | Iwata et al. . | |
| 5,647,330 | | 7/1997 | Sawert et al. . | |
| 5,647,331 | | 7/1997 | Swanson . | |
| 5,694,895 | | 12/1997 | Tsunoda et al. . | |
| 6,012,904 | * | 1/2000 | Tuckey | 417/251 |

* cited by examiner

*Primary Examiner*—Thomas N. Moulis
(74) *Attorney, Agent, or Firm*—Polster, Lieder, Woodruff & Lucchesi, L.C.

(57) ABSTRACT

A two-stage marine fuel pump (10). A first pump stage (S1) has a fuel inlet (24) and a fuel outlet (26). A second pump stage (S2) has a separate fuel inlet (28) and fuel outlet (30). Each pump stage is stand alone such that while the outlet of the first pump stage can be routed to the inlet of the second pump stage, the pump can be otherwise configured. In these other configurations, there is one path for routing fuel to the fuel inlet of the first pump stage and from the outlet thereof, and a separate path for routing fuel to the inlet of the second pump stage and from the outlet thereof. In these alternate configurations fuel pumped from the first stage of the pump is delivered other than to the fuel inlet of the second pump stage, and fuel supplied to the inlet of the second pump stage is delivered other than from the fuel outlet of the first pump stage.

22 Claims, 3 Drawing Sheets

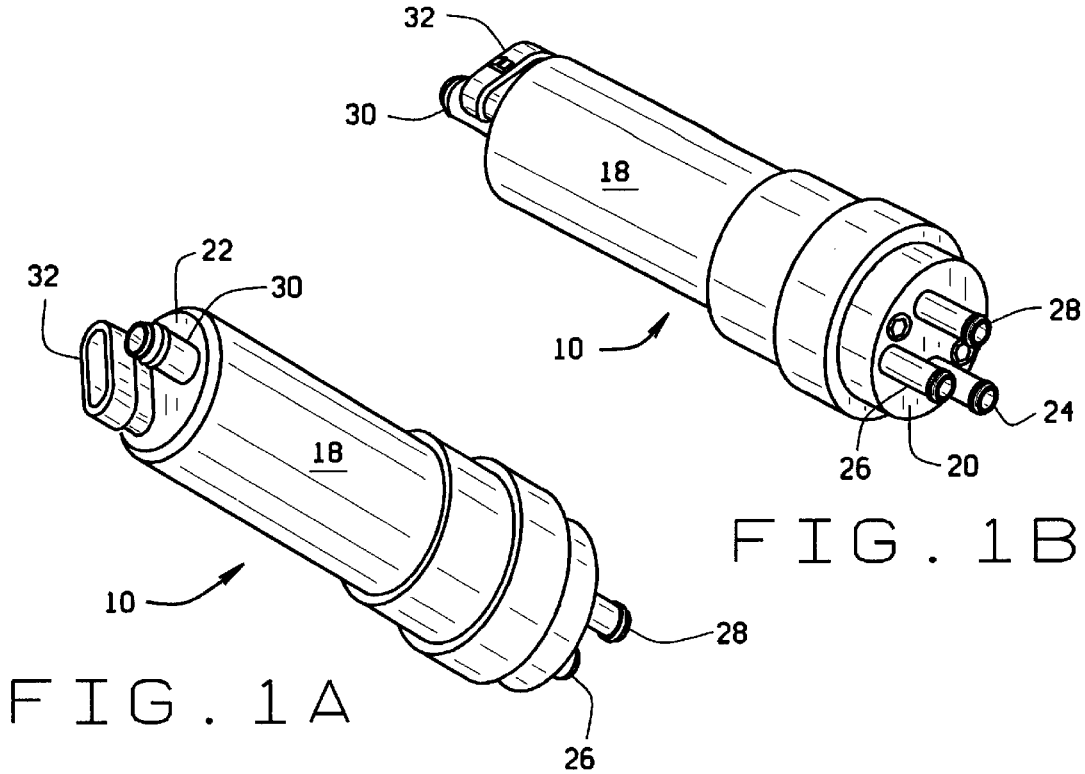
FIG. 1B
FIG. 1A
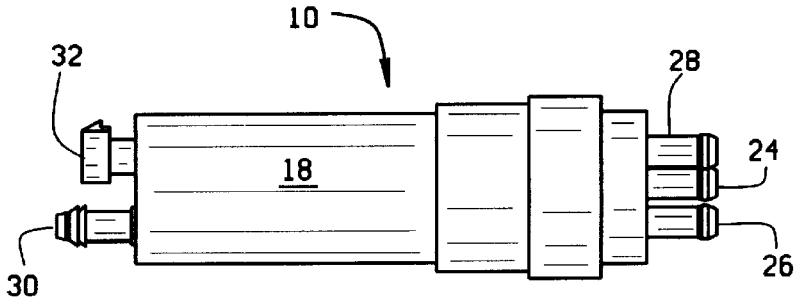
FIG. 1E
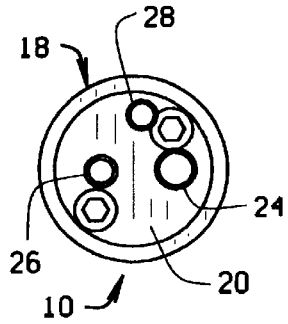
FIG. 1D
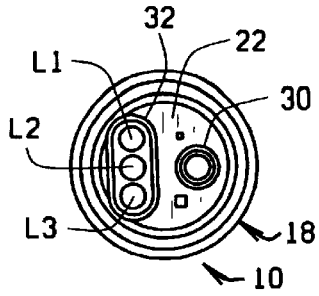
FIG. 1C
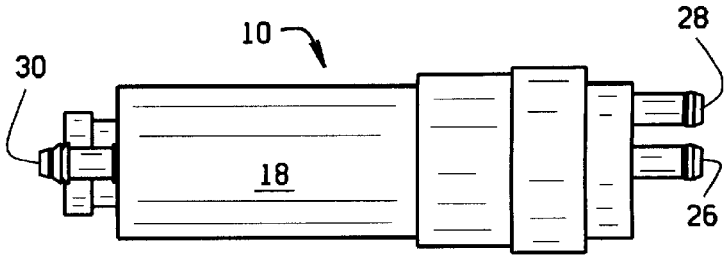
FIG. 1F

STAND ALONE MULTI STAGE FUEL PUMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to multi-stage fuel pumps such as are used in marine engine systems, and more particularly, to a two-stage fuel pump which is used in a stand alone configuration in such systems.

In co-pending, co-assigned U.S. patent application Ser. No. 551,586/09 filed Apr. 18, 2000, there is described a two-stage marine fuel pump used in an integrated fuel system. As described therein, the pump includes first and second pumping elements commonly mounted on a motor driven shaft. Fuel drawn into an inlet of the pump is pumped through the first element (comprising a first pump stage). Fuel expelled from the first stage is pumped into a reservoir from which it is drawn into an inlet of the second pump stage. Outlet fuel from the second stage is pumped to a fuel rail for delivery to a marine engine. All of the pump components are installed in a common housing and the pump has only a single fuel inlet and a single fuel outlet.

It has now been found that the two-stage pump is also useful in a variety of other fuel system configurations. In these applications, it is now advantageous to separate the first stage from the second stage so that even though the common mounting construction of components in the pump is the same as described in the co-pending application, routing of fuel to and from the pump stages allows greater flexibility in use of the pump.

BRIEF SUMMARY OF THE INVENTION

Among the several objects of the present invention is a two-stage marine fuel pump in which fuel is separately supplied to each pump stage rather than the fuel flowing from the first stage flowing directly to an inlet of the second stage.

Another object of the invention is such a fuel pump in which all of the pump components are commonly installed in a single housing, in which the pumping elements comprising the two pump stages are commonly mounted on a single drive shaft, but in which each stage has a separate inlet and a separate outlet.

A further object of the invention is such a fuel pump in which the pump stages can be connected in series, in parallel, or in series-parallel depending upon a particular fuel system application. For example, the pump stages are connected to fuel filters, external fuel pressure regulators, fuel coolers, etc. in implementing different fuel system configurations.

In accordance with the invention, generally stated, a stand alone two-stage marine fuel pump is usable in a variety of fuel system configurations. The pump includes pumping elements for each pump stage which are commonly mounted on a motor driven drive shaft. The first pump stage pumps fuel at a first pressure, and the second stage pumps fuel at a second and higher pressure. There is a separate fuel inlet and fuel outlet for each stage. This allows low pressure fuel from the outlet of the first pump stage to be supplied to one portion of the fuel system, and higher pressure fuel from the outlet of the second stage to be supplied elsewhere in the system. Accordingly, each pump stage is stand alone. In one fuel system configuration, the outlet of the first pump stage is routed to the inlet of the second pump stage. However, in other fuel system configurations, there is one path for routing fuel to the fuel inlet of the first pump stage and from the outlet thereof, and a separate path for routing fuel to the inlet of the second pump stage and from the outlet thereof. In these configurations fuel pumped from the first stage of the pump is delivered other than to the fuel inlet of the second pump stage, and fuel supplied to the inlet of the second pump stage is delivered other than from the fuel outlet of the first pump stage. Other objects and features will be in part apparent and in part pointed out hereinafter.

BRIEF DESCRIPTION OF THE SEVERAL VIEWS OF THE DRAWINGS

In the drawings,

FIGS. 1A and 1B are perspective views of the stand alone fuel pump illustrating each end of the pump, FIGS. 1C and 1D are respective end elevational views of the pump, and FIGS. 1E and 1F are top and side elevational views of the pump;

Corresponding reference characters indicate corresponding parts throughout the drawings.

DETAILED DESCRIPTION OF THE INVENTION

Figure 5:
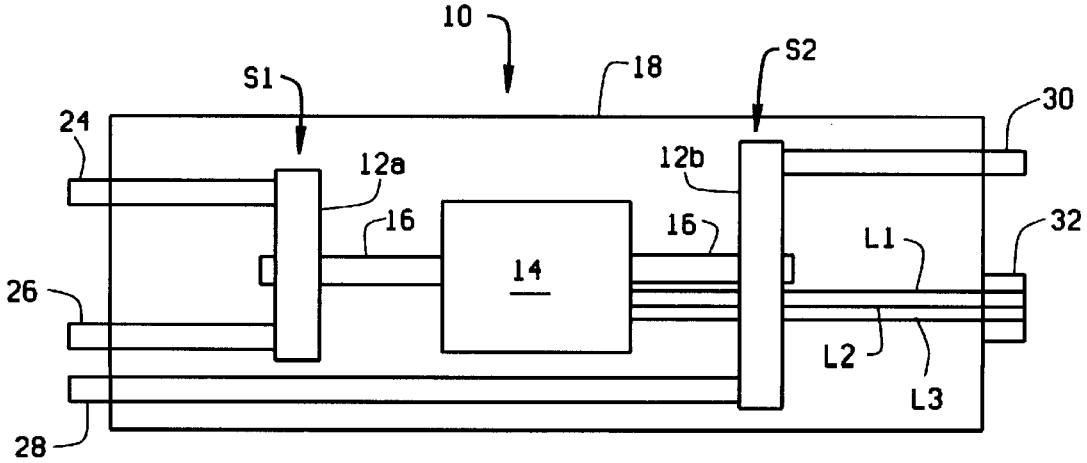

Referring to the drawings, a stand alone two-stage fuel pump of the present invention is indicated generally 10. As shown in FIG. 5, each stage S1 and S2 of pump 10 comprises a positive displacement pump element 12*a* and 12*b* respectively. Because positive displacement pumps and pumping elements are well understood in the art, their design and construction will not be described. A motor 14 has a drive shaft 16 on which the two pump elements are commonly mounted. These pump components are installed in a housing 18. As shown in FIGS. 1A–1F, housing 18 is generally cylindrical in shape and is closed at each end by a cap piece 20, 22 respectively. Fitted in cap piece 20 is an inlet 24 and an outlet 26 for the first stage of the pump. Also fitted in cap piece 20 is an inlet 28 for the second pump stage. Fitted in cap piece 22 is an outlet 30 for the second pump stage. An electrical connector 32 is also fitted in this end piece. The connector is a three terminal connector for three electrical leads L1–L3. Power is supplied to motor 14 from a source of electrical energy over two of the leads and a motor control signal from an on-board computer is provided to the pump over the third lead. It will be understood that the first stage of pump 10 is a low pressure stage providing fuel at 5–10 psi at outlet 26, for example. The second stage of pump 10 provides fuel at a second and higher fuel pressure level of 50–107 psi, for example.

Unlike the two-stage marine pump described in co-pending U.S. application Ser. No. 551,586/09, pump 10 does not have to be configured such that the outlet of the first stage of the pump directly feeds the inlet to the pump's second stage. Rather, each stage S1, S2 of fuel pump 10 is stand alone. That is, a fuel system in which pump 10 is used can be configured so outlet 26 of the first pump stage is connectable to other fuel system components, and other fuel system components are connectable to inlet 28 of the second pump stage, rather than the two pump stages being directly connected to each other.

Figure 2A:
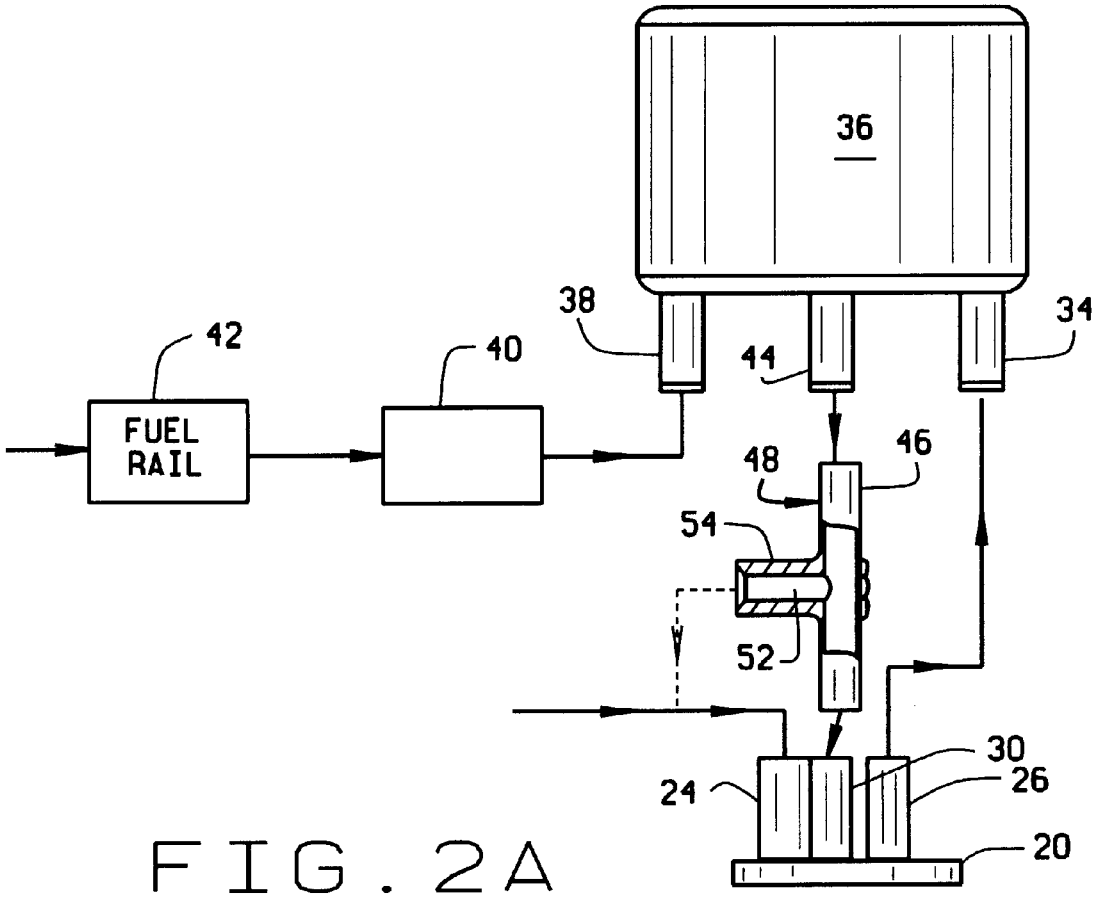
FIGS. 2A and 2B are exploded views (with FIG. 2A partly in section) illustrating one configuration of the stand alone fuel pump in a first fuel system.
Figure 2B:
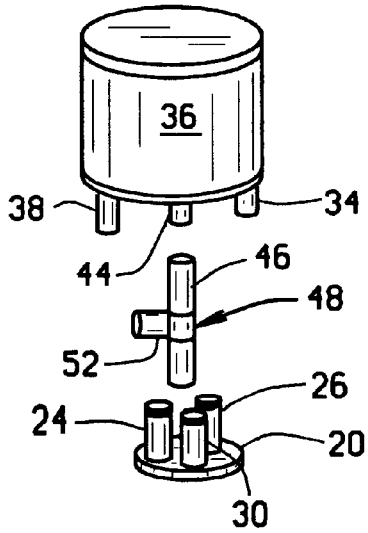

Referring to FIGS. 2A and 2B, fuel from a fuel tank (not shown) is delivered to first stage pump inlet 24 through a conduit (also not shown). Outlet 26 of the first pump stage is now connected to an inlet 34 of a fuel filter 36. Another inlet 38 of the fuel filter is connected to an outlet of a pressure regulator 40 of a fuel rail 42. An outlet 44 of fuel filter 36 is connected to an inlet 46 of a tee-connector 48. An outlet 50 of the connector is attached to inlet 30 of the second stage of fuel pump 10. Connector 48 also has a bypass leg 52 in which is located a regulator valve 54. This leg of the connector is connected to the fluid flow path from the fuel tank to first stage inlet 24 of the pump as indicated by the broken line.

In this configuration, fuel delivered from the fuel tank to the first stage of the pump is pumped through the pump's first stage. The first stage operates as a booster pump in this configuration. The fuel is then delivered from the first stage outlet to fuel filter 36. In addition to filtering the fuel, filter 36 also acts to break up any vapors entrained in the fuel. The filtered fuel is now delivered from the filter to the inlet of the pump's second stage. From the second stage, high pressure fuel is delivered to fuel rail 42 and flows through the rail to a marine engine (not shown). Pressure regulator 40 diverts fuel from rail 42 to filter 36 if the pressure in the fuel rail rises above a predetermined pressure level. In filter 36 this diverted fuel mixes with the fuel delivered from the first stage of pump 10. This fuel is now delivered to inlet 30 of the second stage of the pump through connector 48. If the pressure level of the fuel flowing through the connector is too great, regulator valve 54 opens and some of the fuel is diverted through the valve back to the inlet line from the fuel tank to the first stage of the pump.

Figure 3:
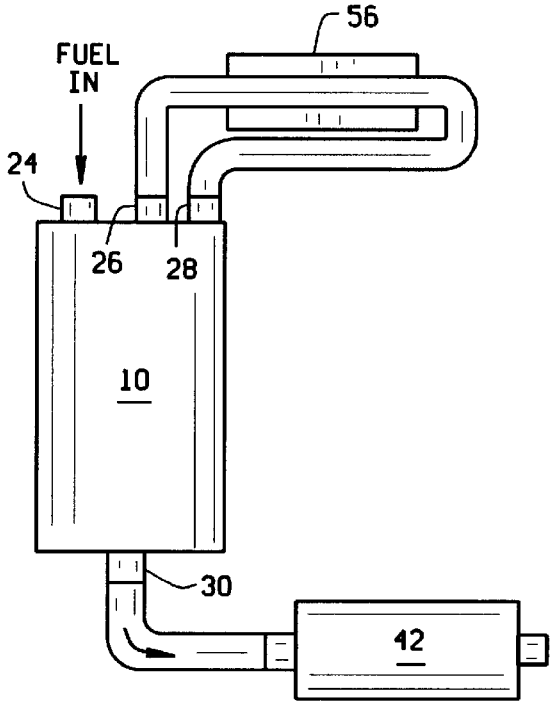
FIGS. 3 and 4 are simplified schematics illustrating other configurations in which the stand alone fuel pump is used; and, FIG. 5 is a simplified representation of the pump.
Figure 4:
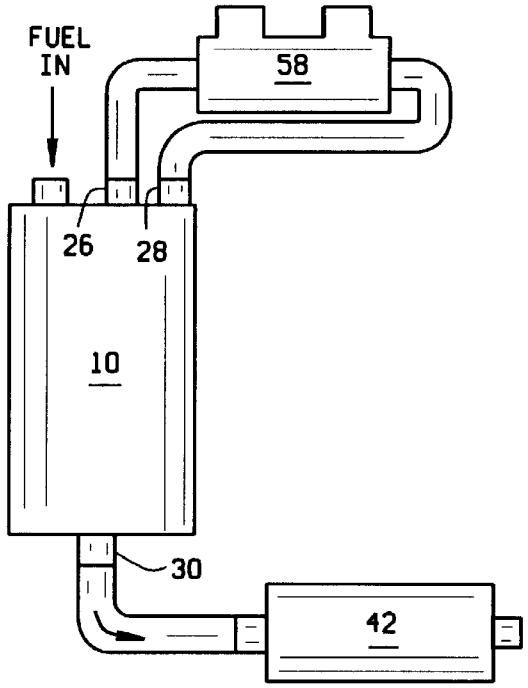

Finally, referring to FIGS. 3 and 4, other pump configurations are shown in which fuel pump 10 is used with a heat exchanger (FIG. 3) or a fuel cooler (FIG. 4). As shown in FIG. 3, fuel pump 10 is delivered fuel from a fuel source to the first stage inlet 24 of the pump. First stage outlet 26 of the pump is now connected to one side of a heat exchanger 56 by which heat is drawn from the fuel to cool the fuel. The outlet side of the heat exchanger is connected to second stage inlet 28 of fuel pump 10. Fuel pumped from second stage outlet 30 of the pump is delivered to the inlet of fuel rail 42 for delivery to the engine.

The configuration shown in FIG. 4 is similar to that shown in FIG. 3, except now the fuel from the first stage of the pump is delivered to a cooler 58. Water circulating through the cooler cools the fuel which is then delivered to the second stage of pump 10 and from the pump to the fuel rail.

It is a feature of stand alone fuel pump 10 that it is compatible with various fuel system configurations. Thus, as shown in FIGS. 3 and 4, the pump can be used where the first and second pump stages are arranged in series; while in FIG. 2, a series-parallel configuration is employed. While not shown in the drawings, it will be understood that a parallel arrangement of the pump stages could also be used in which fuel is separately supplied to the inlet of each pump stage with the low pressure fuel from the first stage outlet and high pressure fuel from the second stage outlet are each supplied to portions of the fuel system.

What has been described is a two-stage marine fuel pump wherein fuel is separately supplied to each pump stage rather than flowing directly from one stage to the other. All of the pump components commonly mount in a single housing with the elements comprising the pump stages being commonly mounted on a motor drive shaft. Each pump stage, however, has a separate inlet and outlet. The pump stages are connected in series, parallel, or series-parallel depending upon a particular fuel system application.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A stand alone two-stage marine fuel pump comprising:

a first pump stage having a fuel inlet and a fuel outlet;

a second pump stage having a separate fuel inlet and fuel outlet, each of said first and second pump stages comprising a positive displacement pumping element; and, means for routing fuel to the fuel inlet of the first pump stage and from the outlet thereof, and separate means for routing fuel to the inlet of the second pump stage and from the outlet thereof whereby fuel pumped from the first stage of the pump is delivered other than to the fuel inlet of the second pump stage and fuel supplied to the inlet of the second pump stage is delivered other than from the fuel outlet of the first pump stage.

2. The stand alone fuel pump of claim 1 wherein each pump stage pumps fuel at a different pressure level.

3. The stand alone fuel pump of claim 2 wherein the second pump stage pumps fuel at a higher pressure level than the first pump stage.

4. The stand alone fuel pump of claim 1 wherein the first and second pump stages are connected in series with each other.

5. The stand alone fuel pump of claim 1 wherein the first and second pump stages are connected in parallel with each other.

6. The stand alone fuel pump of claim 1 wherein the first and second pump stages are connected in a series-parallel arrangement.

7. A two-stage fuel pump for use in a fuel system comprises a first pump stage having a fuel inlet and a fuel outlet, and a second pump stage having a separate fuel inlet and fuel outlet, the outlet of the first pump stage being routed elsewhere in the fuel system other than to the fuel inlet of the second pump stage, and fuel is delivered to the fuel inlet of the second pump stage other than from the fuel outlet of the first pump stage whereby each pump stage is a stand alone stage not requiring fluid communication with the other pump stage in order to supply fuel under pressure to other components of the fuel system, and wherein the first pump stage pumps fuel at one pressure level and the second pump stage pumps fuel at a second and higher pressure level than the first pump stage, each pump stage comprising a positive displacement pumping element.

8. The fuel pump of claim 7 wherein the first and second pump stages are connected in series with each other.

9. The fuel pump of claim 7 wherein the first and second pump stages are connected in parallel with each other.

10. The fuel pump of claim 7 wherein the first and second pump stages are connected in a series-parallel arrangement.

11. A stand alone two-stage marine fuel pump comprising:

a first pump stage having a fuel inlet and a fuel outlet;

a second pump stage having a separate fuel inlet and fuel outlet, the first and second pump stages being connected in parallel with each other; and, means for routing fuel to the fuel inlet of the first pump stage and from the outlet thereof, and separate means for routing fuel to the inlet of the second pump stage and from the outlet thereof whereby fuel pumped from the first stage of the pump is delivered other than to the fuel inlet of the second pump stage and fuel supplied to the inlet of the second pump stage is delivered other than from the fuel outlet of the first pump stage.

12. A stand alone two-stage marine fuel pump comprising:

a first pump stage having a fuel inlet and a fuel outlet;

a second pump stage having a separate fuel inlet and fuel outlet, the first and second pump stages being connected in a series-parallel arrangement; and, means for routing fuel to the fuel inlet of the first pump stage and from the outlet thereof, and separate means for routing fuel to the inlet of the second pump stage and from the outlet thereof whereby fuel pumped from the first stage of the pump is delivered other than to the fuel inlet of the second pump stage and fuel supplied to the inlet of the second pump stage is delivered other than from the fuel outlet of the first pump stage.

13. A two-stage fuel pump for use in a fuel system comprises a first pump stage having a fuel inlet and a fuel outlet, and a second pump stage having a separate fuel inlet and fuel outlet, the first pump stage pumping fuel at one pressure level and the second pump stage pumping fuel at a second pressure level, the two pump stages being connected in parallel with each other with the outlet of the first pump stage being routed elsewhere in the fuel system other than to the fuel inlet of the second pump stage, and fuel is delivered to the fuel inlet of the second pump stage other than from the fuel outlet of the first pump stage whereby each pump stage is a stand alone stage not requiring fluid communication with the other pump stage in order to supply fuel under pressure to other components of the fuel system.

14. The two stage fuel pump of claim 13 wherein each pump stage comprises a positive displacement pump.

15. The two stage fuel pump of claim 13 wherein the second pump stage pumps fuel at a higher pressure level than the first pump stage.

16. A two-stage fuel pump for use in a fuel system comprises a first pump stage having a fuel inlet and a fuel outlet, and a second pump stage having a separate fuel inlet and fuel outlet, the first pump stage pumping fuel at one pressure level and the second pump stage pumping fuel at a second pressure level, the two pump stages being connected in a series-parallel arrangement with the outlet of the first pump stage being routed elsewhere in the fuel system other than to the fuel inlet of the second pump stage, and fuel is delivered to the fuel inlet of the second pump stage other than from the fuel outlet of the first pump stage whereby each pump stage is stand alone stage not requiring fluid communication with the other pump stage in order to supply fuel under pressure to other components of the fuel system.

17. The two stage fuel pump of claim 16 wherein each pump stage comprises a positive displacement pump.

18. The two stage fuel pump of claim 16 wherein the second pump stage pumps fuel at a higher pressure level than the first pump stage.

19. A two-stage fuel pump for use in a fuel system comprises a first pump stage having a fuel inlet and a fuel outlet, and a second pump stage having a separate fuel inlet and fuel outlet, the first pump stage and second pump stage each comprising a positive displacement fuel pump with the outlet of the first pump stage being routed elsewhere in the fuel system other than to the fuel inlet of the second pump stage, and fuel is delivered to the fuel inlet of the second pump stage other than from the fuel outlet of the first pump stage whereby each pump stage is stand alone stage not requiring fluid communication with the other pump stage in order to supply fuel under pressure to other components of the fuel system.

20. The two stage fuel pump of claim 19 wherein the second pump stage pumps fuel at a higher pressure level than the first pump stage.

21. The two stage fuel pump of claim 19 wherein the two pump stages are connected in parallel with each other.

22. The two stage fuel pump of claim 19 wherein the two pump stages are connected in a series-parallel arrangement.

* * * * *